US008381461B2

(12) United States Patent
Repasky

(10) Patent No.: US 8,381,461 B2
(45) **Date of Patent: *Feb. 26, 2013**

(54) STABILIZING SYSTEMS FOR DECK PEDESTALS

(76) Inventor: John Repasky, Hanover, PA (US)

( * ) Notice: Subject to any disclaimer, the term of this patent is extended or adjusted under 35 U.S.C. 154(b) by 46 days.

This patent is subject to a terminal disclaimer.

(21) Appl. No.: 12/417,942

(22) Filed: Apr. 3, 2009

(65) Prior Publication Data

US 2009/0188189 A1 Jul. 30, 2009

Related U.S. Application Data

(63) Continuation-in-part of application No. 11/555,716, filed on Nov. 2, 2006, now abandoned.

(51) Int. Cl.
*E04B 9/00* (2006.01)

(52) U.S. Cl. ..... 52/126.6; 52/126.1

(58) Field of Classification Search ..... 52/263, 52/126.1, 126.4, 126.5, 126.6, 126.7, 300, 52/301, DIG. 11

See application file for complete search history.

(56) References Cited

U.S. PATENT DOCUMENTS

| | | | | |
|---|---|---|---|---|
| 4,085,557 | A | 4/1978 | Tharp | |
| 4,277,923 | A * | 7/1981 | Rebentisch et al. | 52/126.6 |
| 4,558,544 | A | 12/1985 | Albrecht et al. | |
| 4,570,397 | A | 2/1986 | Creske | |
| 4,759,162 | A | 7/1988 | Wyse | |
| 4,996,804 | A | 3/1991 | Naka et al. | |
| 5,333,423 | A | 8/1994 | Propst | |
| 5,377,468 | A | 1/1995 | Repasky | |
| 5,442,882 | A | 8/1995 | Repasky | |
| 5,588,264 | A | 12/1996 | Buzon | |
| 5,791,096 | A * | 8/1998 | Chen | 52/126.6 |
| 5,862,635 | A * | 1/1999 | Linse et al. | 52/126.6 |
| 6,332,292 | B1 | 12/2001 | Buzon | |
| 6,363,685 | B1 * | 4/2002 | Kugler | 52/745.05 |
| 6,520,471 | B2 * | 2/2003 | Jones et al. | 248/346.5 |
| 6,604,330 | B2 | 8/2003 | Repasky | |
| 2002/0078638 | A1 | 6/2002 | Huang | |
| 2002/0148173 | A1 | 10/2002 | Kugler | |
| 2004/0035064 | A1 | 2/2004 | Kugler et al. | |
| 2008/0053017 | A1 | 3/2008 | Hockemeyer et al. | |
| 2008/0053018 | A1 | 3/2008 | Hockemeyer et al. | |
| 2008/0222973 | A1 | 9/2008 | Lee et al. | |

OTHER PUBLICATIONS

Bison, "Bison Deck Supports ScrewJack B-Series Specifications", pp. 1-4, Oct. 6, 2005.

(Continued)

*Primary Examiner* — Jessica Laux
(74) *Attorney, Agent, or Firm* — Barley Snyder

(57) ABSTRACT

A stabilizing system for a deck system has a plurality of pedestals, a plurality of connection locations on a periphery of the pedestals and at least one stabilizing member secured g between the pedestals. Each of the pedestals supports corner portions of adjacent blocks, pavers or panels a spaced distance above an underlying structure extending generally parallel to the blocks, pavers or panels. The plurality of connection locations on a periphery of the pedestals are located both proximate the supported corner portions and proximate the underlying structure. At least one stabilizing member in the form of a stabilizing bar, elongate wires, wire rope, cable or rods is secured to and extends between the connection locations of at least two of the pedestals.

25 Claims, 5 Drawing Sheets

OTHER PUBLICATIONS

Bison, "Bison ScrewJack B Series Pedestals", pp. 1-2, Sep. 30, 2005.
Elmich, "VersiJack", 9 pages, Oct. 9, 2006.
Wausau Tile, "Pedestal/Roof Deck System Components", (http://www.wausautile.com/paving/pedestalRoofDeckSystems.cfm) Apr. 3, 2009.
Wausau Tile, "Terra System One Level Installation, Terr-Adjust System", (http://www.wausautile.com), Apr. 3, 2009.
Wausau Tile, "Terra System One Level Installation, Terra-Stand System", (http://www.wausautile.com), Apr. 3, 2009.
Westile, "Pedestals", (http://www.westile.com/pedestal.asp?img=13&cat=comm&ped=acc) Apr. 3, 2009.
Westile, "ScrewJack Pedestals", (http://www.westile.com), Dec. 2006.

* cited by examiner

STABILIZING SYSTEMS FOR DECK PEDESTALS

CROSS-REFERENCE TO RELATED APPLICATIONS

This application is a continuation-in-part application of U.S. patent application Ser. No. 11/555,716, filed Nov. 2, 2006 now abandoned.

FIELD OF THE INVENTION

The present invention relates generally to pedestals for deck systems and more particularly to stabilizing systems for such deck systems.

BACKGROUND

Roof structures of many buildings are capable of supporting a substantially horizontal surface, or deck, enabling the construction of roof terraces, pedestrian walkways, roof gardens, plaza decks, sun decks, balconies, patios or the like. Such roof surfaces are often formed at a slight slope relative to horizontal for drainage purposes. Typically, the roof surface itself is not constructed of a material that provides a suitable traffic bearing surface nor is it aesthetically pleasing.

Examples of deck systems utilizing roof pavers, or ballast blocks, are disclosed by U.S. Pat. Nos. 5,887,397; 5,377,468; 5,442,882; and 6,604,330 B2 issued to Repasky. Also see U.S. Pat. Nos. 4,570,397 issued to Creske; and 5,588,264 and 6,332,292 B1 issued to Buzon.

While the rooftop ballast block deck systems disclosed in the above referenced patents may be satisfactory for their intended purposes, there is a need, especially with systems using height adjustable pedestals, for stabilizing systems. Such stabilizing systems are needed to minimize movement of the ballast block deck systems which they support.

SUMMARY

In view of these needs, the present invention provides a stabilizing system which restrains relative movement of the pedestals it supports. The stabilizing system has a plurality of connection locations on a periphery of the pedestals and at least one stabilizing member secured g between the pedestals. Each of the pedestals supports corner portions of adjacent blocks, pavers or panels a spaced distance above an underlying structure extending generally parallel to the blocks, pavers or panels. The plurality of connection locations on a periphery of the pedestals are located both proximate the supported corner portions and proximate the underlying structure. At least one stabilizing member is secured to and extends between the connection locations of at least two of the pedestals.

BRIEF DESCRIPTION OF THE DRAWINGS

The features and advantages of the present invention should become apparent from the following description when taken in conjunction with the accompanying drawings, in which.

DETAILED DESCRIPTION OF THE EMBODIMENT(S)

Figure 1:
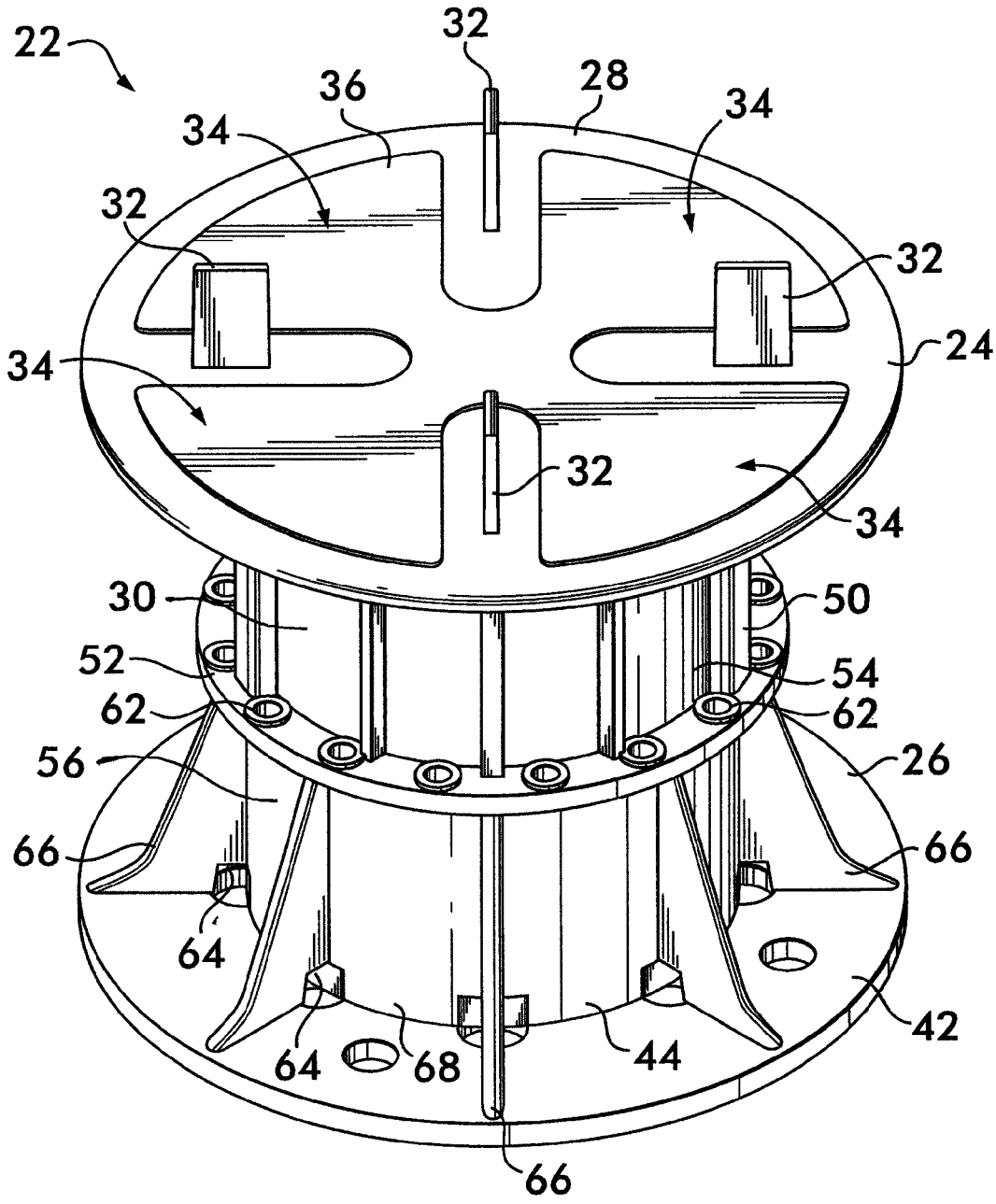
FIG. 1 is a perspective view of a pedestal embodying the present invention.

Referring now to the drawings, a deck 10 is constructed of a plurality of separate, substantially-rectangular pavers, ballast blocks, or panels 12 (hereinafter referred to as blocks) that are arranged in a grid layout, or pattern, and that are supported a spaced distance above a surface, such as an exterior roof surface 14 of a building. The deck 10 provides a substantially level traffic-bearing surface 16 for pedestrians and an aesthetic appearance. It can be used to convert an otherwise unusable rooftop or like space into a useful area.

Each block 12 can be made of concrete, marble, granite, wood, rubber, plastic, composite materials, or like weight-bearing substance and is typically square, rectangle, or some other shape that can be positioned in uniform patterns. Thus, each block 12 will typically have corner portions 18, and the deck 10 will have intersection areas 20 in which corner portions 18 of adjacent blocks 12 extend. A separate pedestal 22 underlies each intersection area 20 and supports the corner portions 18 of the adjacent ballast blocks 12. Thus, the entire deck 10 is elevated from an underlying structure, such as exterior roof surface 14 which extends and lies generally parallel to the deck 10. The spacing provided between the blocks 12 and surface 14 and between the laterally positioned blocks 12 permits proper drainage of fluids, such as rain, through the deck 10.

As best illustrated in FIG. 1, each pedestal 22 includes a support 24 at an upper end thereof and a base 26 at a lower end thereof. The presence of an intermediate coupler 50, as shown in FIG. 1, is optional. In its simplest form, the pedestal 22 can consist solely of the support 24 and base 26 without an intermediate coupler 50. The support 24 and base 26 are preferably manufactured separately and may be molded of plastic. The support 24 and base 26 interconnect in a manner permitting an overall height of the pedestal 22 to be adjusted. More specifically, the action of rotating the support 24 relative to the base 26 causes the height of the pedestal 22 to be altered. Thus, the height of each pedestal 22 in the deck 10 can be readily adjusted, as required, during installation of the deck 10 and/or during maintenance thereof.

In the illustrated embodiment, the support 24 includes a plate 28 with a substantially cylindrical post 30 depending therefrom. In use, the plate 28 is disposed in a substantially horizontal position thereby providing a surface on which the corner portions 18 of the blocks 12 can be supported. Preferably, a plurality of upstanding walls 32 project from the plate 28 and define separate quadrants 34 on the plate 28. Each quadrant 34 receives one corner portion 18 of a block 12. The walls 32 align the corner portions 18 on the pedestal 22 and define lateral spacing between adjacent blocks 12 to permit rain water and other fluids to drain through the deck 10 and around the outside of plate 28.

Figure 2:
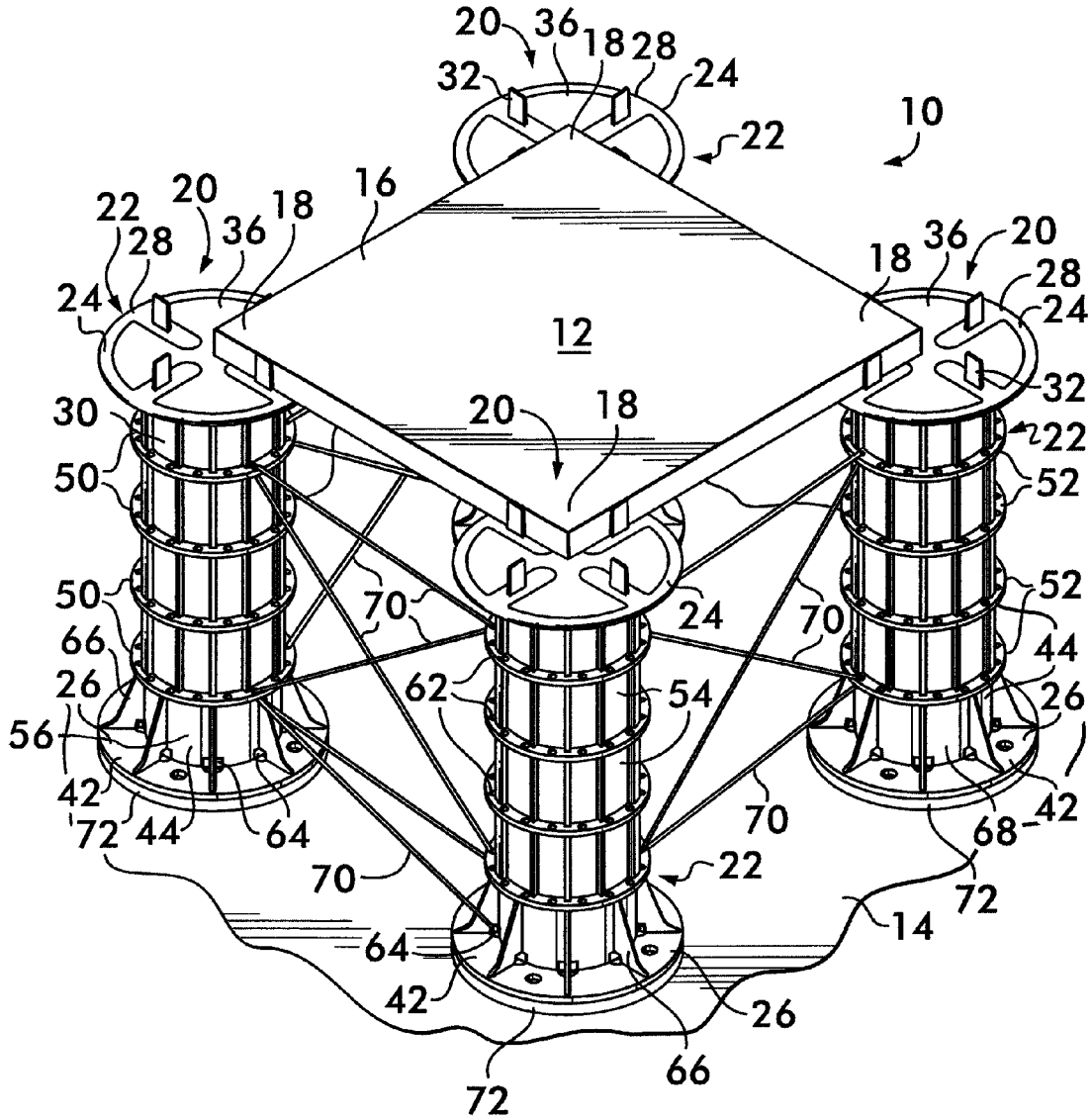
FIG. 2 is a perspective view of a part of a deck system having cross bracing between adjacent pedestals according to the present invention.

One or more couplers 50 can be assembled between the support 24 and base 26 to add further height to the pedestal 22. For example, FIG. 2 shows the use of a couplers 50. Each coupler 50 is identical and separately manufactured from preferably the same material as the support 24 and base 26.

Each coupler 50 includes a flange, or collar 52, from which a substantially cylindrical, hollow post 54 projects and another substantially cylindrical post depends (not shown) and receivable by the base 26 (as shown). In this configuration, the flange 52 extends circumferentially about a mid-section of the coupler 50 and extends laterally therefrom. Continuous or discontinuous spiral threads (not shown) are provided on an inner surface of the hollow post 54 and are capable of cooperatively engaging threads on a post 30 of the support 24. In addition, continuous or discontinuous spiral threads (not shown) are provided on an outer surface of the hollow post depending from the flange, and are capable of cooperatively engaging the threads on post of the base 26. Each of the continuous or discontinuous spiral threads positioned in the hollow post 54 and on the other hollow post (not shown) of the coupler 50 are received by the support 24 and base 26 respectively. For instance, in FIG. 3, the base 26 is shown having continuous spiral threads that are engageable with the continuous or discontinuous spiral threads provided on other hollow post. Accordingly, the coupler 50 can be used to interconnect the support 24 to the base 26. Further, the couplers 50 are designed to interconnect to each other so that multiple couplers 50 can be interconnected between the support 24 and the base 26. Rotation of the couplers 50, support 24, and base 26 relative to each other can be used to adjust the overall height of the pedestal 22.

Preferably, the flange 52 of each coupler 50 extends in a plane that is substantially parallel to the support plate 28 and base plate 42. See FIG. 1. In the illustrated embodiments, the flange 52 is annular; however, it could be of any shape in plan. In addition, the support plate 28 may be of a similar size, in plan, to that of the base plate 42. For example, both plates 28 and 42 can be provided in a circular shape, in plan, having substantially identical diameters. Alternatively, the plates, 28 and 42, and the flange 52 can be of different shapes and sizes.

The flange 52 preferably has a series of connection locations 62 which in this embodiment are formed as eyelets extending therethrough. For instance, the connection locations 62 can be provided as apertures that are circumferentially spaced-apart about the mid-section of the coupler 50. The connection locations 62 as shown in FIG. 1. may include optional reinforcements which extend around the aperture and outward from the flange surface. In the illustrated embodiment, sixteen separate connection locations 62 are equally spaced-apart about the coupler 50. Fewer or more connection locations 62 can be provided on the annular flange 52. The connection locations 62 are used for securing the ends of bracing wires to the pedestal 22. The uniform distribution of closely-spaced connection locations 62 about the coupler ensures that a connection location 62 will always be opposed to an connection location 62 in an adjacent pedestal 22 thereby enabling ease of installation of the bracing. Thus, connection locations 62 should be readily available at most or substantially all locations about the coupler for ready coupling of bracing wires between pedestals. The bracing should not be required to be bent or the like due to the unavailability of connection locations 62 and should not generate forces that may cause undesired rotation of any components of the pedestals 22.

The base 26 can also be provided with connection locations 64, such as brace securement eyelets. For example, each base 26 can have a plurality of reinforcement walls 66 that extend radially-from an exterior 68 of the post 44. The walls 66 can be spaced-apart circumferentially about the post 44 and can extend integrally from both the plate 42 and post 44 of the base 26. Connection locations 64 can be provided in the walls 66. In the illustrated embodiment, the connection locations 64 are provided adjacent an area on the base 26 where the post 44 interconnects with the plate 42.

As best shown in FIG. 2, a stabilizing system for the deck system may include cross bracing that ties adjacent pedestals 22 together and restrains their movement relative to one another. It should be noted here that the cross bracing, imparts a degree of rigidity over the entire height of the system between the surface 14 and the blocks 12. The bracing can include elongate wires, wire rope, cable or rods, 70 that are secured to adjacent pedestals 22. The bracing 70 can extend substantially horizontal or can extend at angles to the horizontal whereby the angular bracing imparts greater rigidity and stability in the area between the surface 14 and the blocks 12. For instance, X-bracing patterns can be utilized. The ends of the bracing wires 70 can be crimped and secured to the connection locations, 62 and 64, of the pedestals 22, and the wires 70 can extend coupler-to-coupler using connection locations 62 or base-to-coupler using connection locations 62 and 64.

Figures 3, 4:
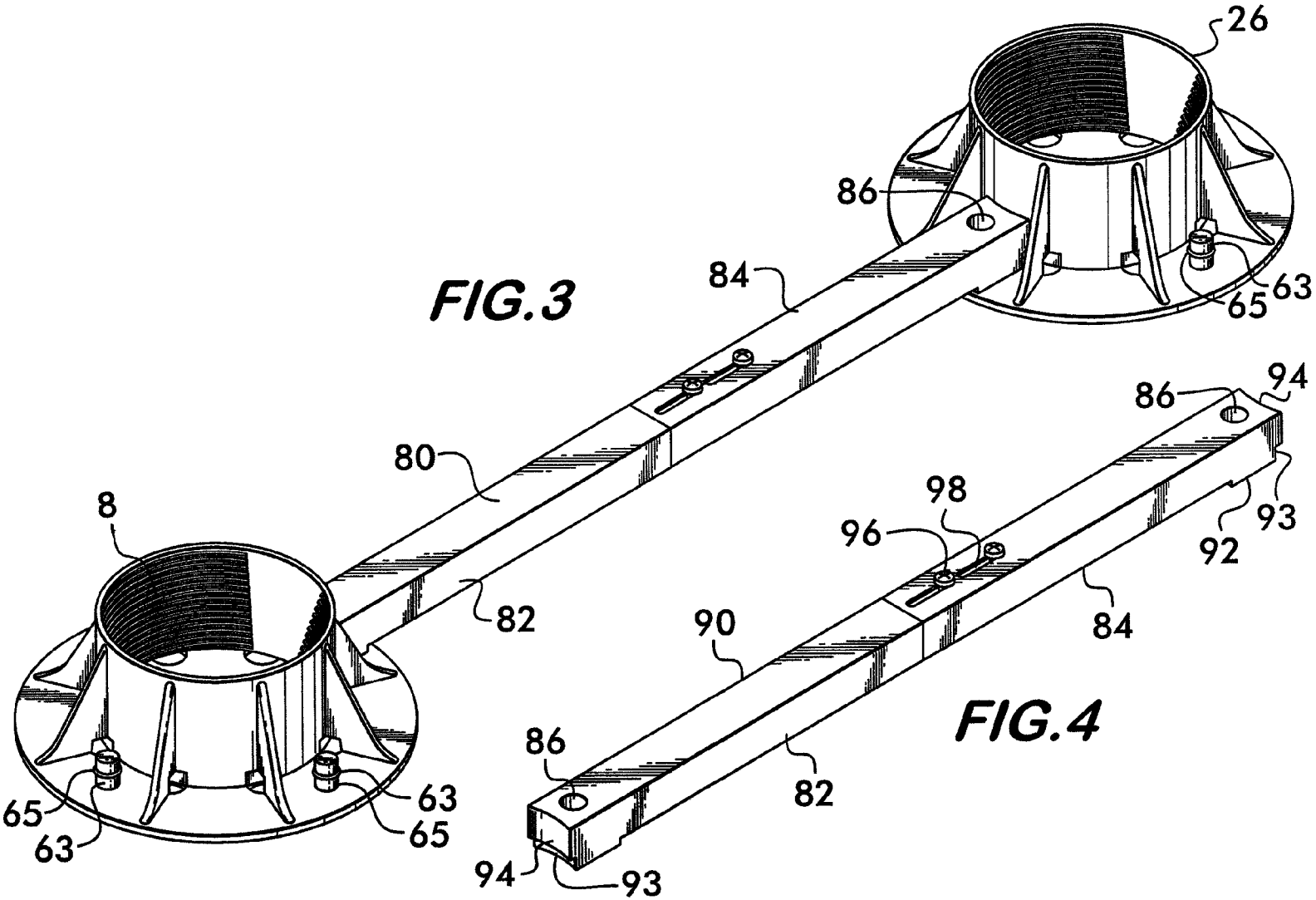
FIG. 3 is a perspective view of an alternate pedestal.
FIG. 4 is a top perspective view of stabilizer bar for use with the an alternate pedestal of FIG. 3.
Figures 4A, 5:
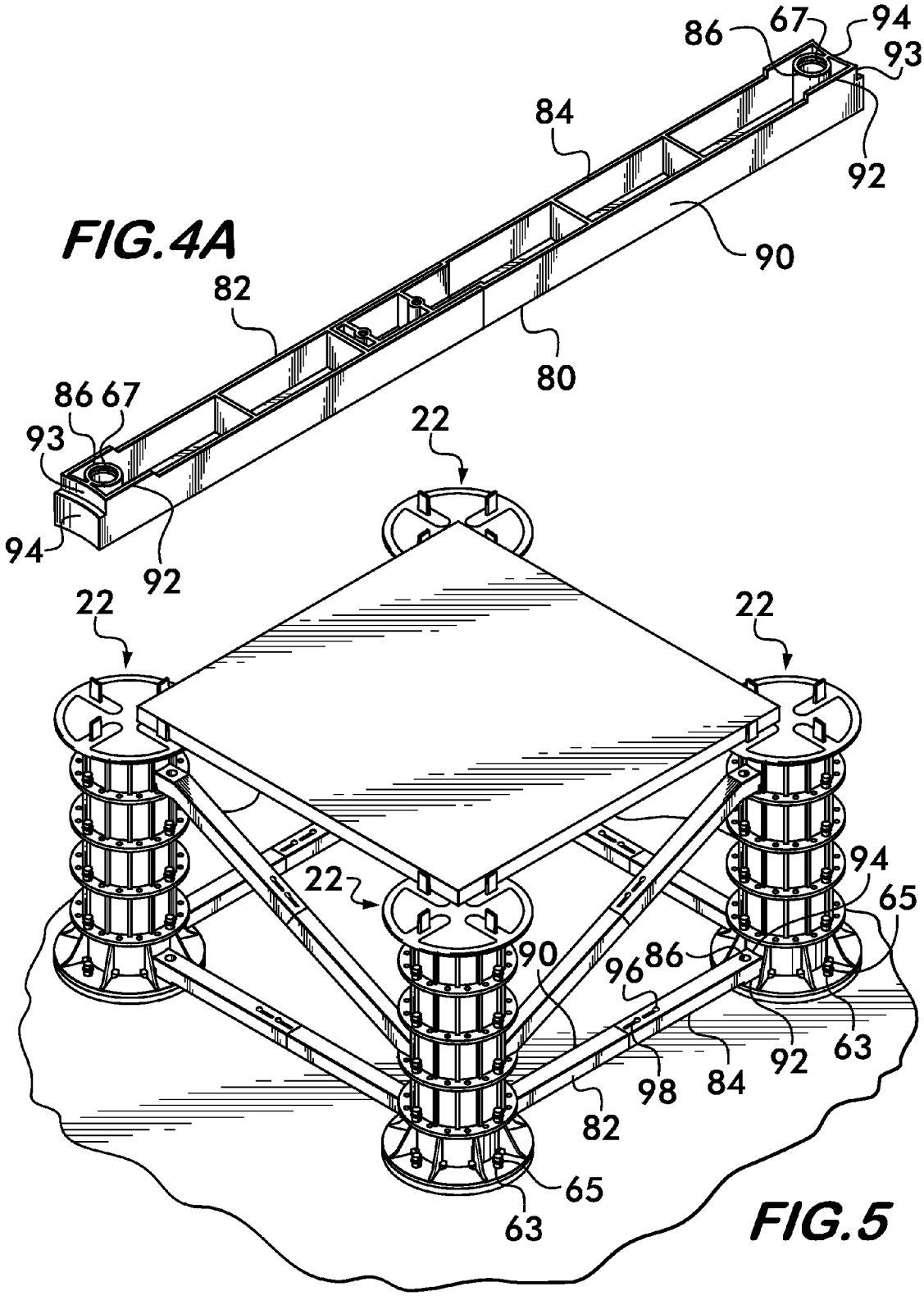
FIG. 4A is a bottom perspective view of stabilizer bar of FIG. 4.
FIG. 5 is a perspective view of a part of a deck system having stabilizer bars between adjacent pedestals according to the present invention.

The stabilizing system may include a stabilizing bar 80 utilized in place of the elongate wires, wire rope, cable or rods 70. Such stabilizing bars 80 extend substantially horizontally or at angles to the horizontal between adjacent pedestals 22 as best shown in FIG. 5. The stabilizing bar 80 will now be described in greater detail with reference to FIGS. 3, 4 and 4A. The stabilizing bar 80 is formed of two telescoping halves 82, 84. Each of the telescoping halves 82, 84 are connected to each other through a telescoping arrangement wherein the first half 82 contains at least one projection or fastener 96 such as a screw, bolt, snap or latching projection or any other suitable fastener located along a top surface 91. The fastener 96 is positioned along the top surface 91 to engage a securing slot 98 located along the top surface 91 of the second half 84. The securing slot 98 shown here to be generally oval in shape, may be optionally profiled to have a wider portion for receiving the projection or fastener 96 and a narrower portion into which the projection or fastener 96 slides to secure it in the slot 98. The telescoping nature along with the slot and fastener arrangement allow the stabilizing bar 80 to be adjustable in length between end faces 94. The adjustment facilitates use with various size blocks 12 or facilitates adjustment that may be necessary because of block size variances within tolerances. As an alternative, the stabilizing bar 80 may be one piece formed of an appropriate length without telescoping halves. The end faces 94, are contoured to complement the end surface of the pedestal base 26 which it engages. The top and bottom surfaces 91, 92 extend between the end faces 94. It should be understood by those reasonably skilled in the art that while the top and bottom surfaces 91, 92 are shown here as being either a flat or contoured, any suitable contour for either surface is within the spirit of the invention. Here, in this exemplary embodiment, the bottom surface 92 is shown to have a contour which allows water and/or debris to flow thereunder for better drainage. The contour has a raised portion in the mid-section or center of the stabilizing bar 80 with steps located near the end faces 94 which engage the base 26. Adjacent to each end face 94, a securing opening 86 extends between the top and bottom surfaces 91, 92. The securing opening may optionally extend from the bottom surface 92 up toward a closed end near the top surface 91 to form a blind hole. The securing openings 86 are positioned to engage a connection location, in this embodiment, formed as a projection 63 along the pedestal base 26 to secure the stabilizing bar 80 to the pedestal base 26. The projections 63 are profiled to have a draft angle or as shown in the example of FIG. 3, bump 65 for frictionally engaging the securing opening 86 thereon. Likewise, the securing openings 86 have a complementary inner profile with a draft or bump receiving recess 67 for frictionally engaging the projections 63. The profiles and complementary profiles may be arranged to have a tactile indication of securement such a click to indicate and ensure proper engagement between the pedestal base 26 and stabilizing bar 80. Although the projections 63 are shown here to be generally cylindrical, they may have other tubular shapes such as a rectangular or square tubular shapes or any shape which is capable of receiving a complementary shape of the securing opening 86. Also, although the projections 63 are shown here to be on the base 26 and the openings on the stabilizing bar 80, it will be understood by those reasonably skilled in the art that the connection arrangement may be reversed whereby the projections are located on the stabilizing bar 80 and the openings are located on the base 26.

Figure 6:
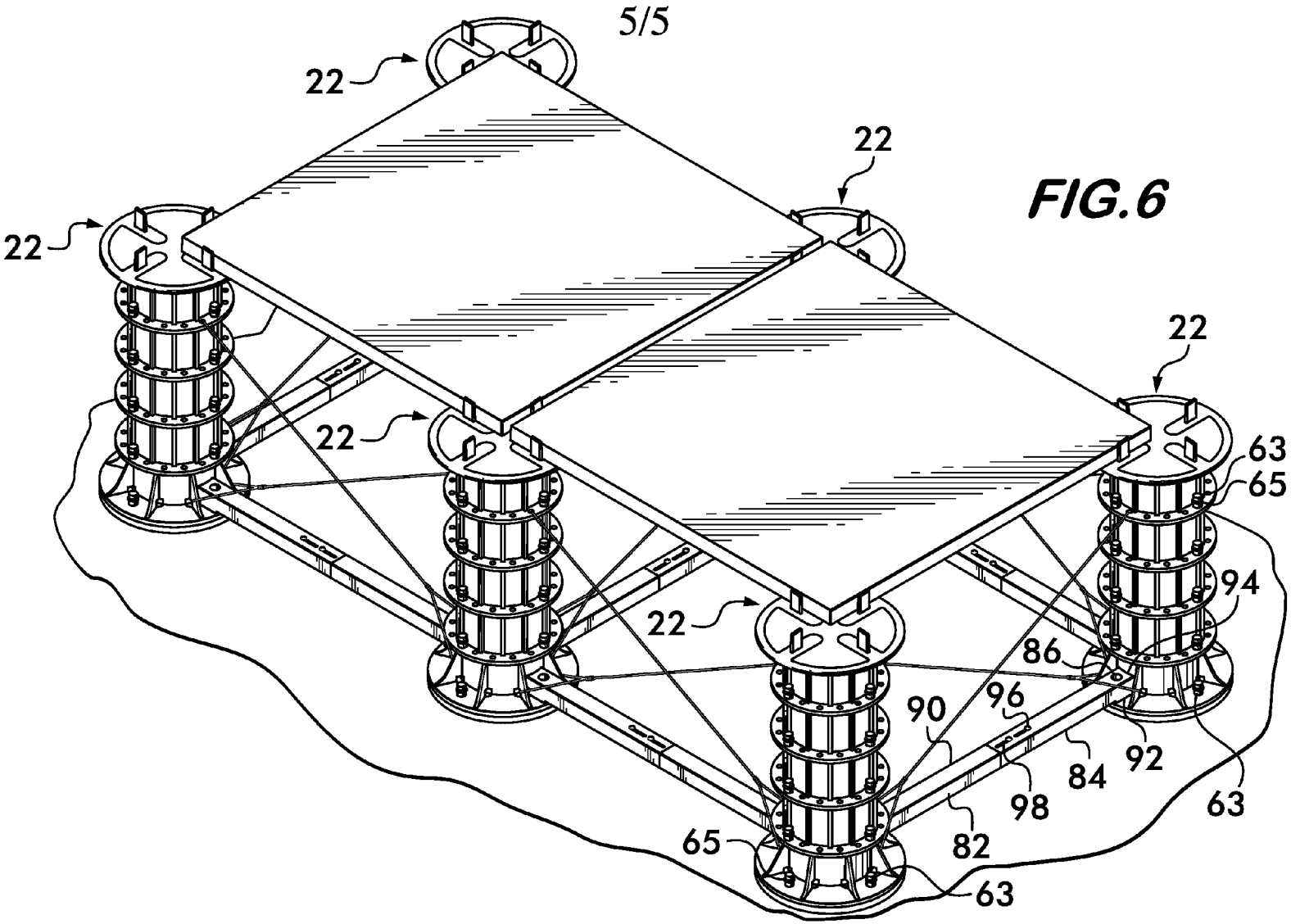
FIG. 6 is a perspective view of a part of a deck system having stabilizer bars and cross bracing between adjacent pedestals according to the present invention.

It should be understood by those reasonably skilled in the art that although FIG. 2 shows a stabilizing system having bracing wires 70 between connection locations 62,64 and FIG. 4 shows a stabilizing system having stabilizing bars 80 between connection locations 63, any combination of such connection locations 62, 63, 64, bracing wires 70, and stabilizing bars 80, are possible and within spirit of the invention. Also, diagonal stabilizing bars may be formed in an X-pattern, either from two bars being interconnected or by a unitary X-shaped bar. Additionally, such bracing 70 or stabilizing bars 80 may be selectively applied or excluded as necessary. For example, FIG. 6 shows the bracing 70 excluded from the top horizontal locations adjacent to the block 12. A particular application may, for example, call for a stabilizing system suited to have a combination of stabilizing bars 80 located along bottom bases 26 and bracing wires 70 extending between supports 24 as best shown in FIG. 6. In that illustrative embodiment, stabilizing bars 80 are provided horizontally proximate to the underlying structure while wires 70 are located in locations as cross bracing above the stabilizing bars 80. The stabilizing bars 80 advantageously prevent movement of the pedestals 22 either toward or away from each other. As an alternative, best shown in FIG. 6, the wires 70 may be wrapped around the stabilizing bars 80 by passing the wire 70 trough each of two connection locations 64 adjacent to each side of the stabilizing bar 80. After being passed through both connection locations 64 the wire 70 is joined to itself above the stabilizing bar 80. The stabilizing bar 80, in that embodiment, may have optional notches 93 in the end faces 94 near the bottom surface 92 for passing the wires therethrough.

The above-described deck system and pedestal assembly according to the present invention provides a stable elevated traffic bearing surface for pedestrians and the like on an existing structure, such as rooftop. The deck is easy to install and inexpensive to manufacture. The height of each pedestal can be adjusted by rotating the support relative to the base or by adding or subtracting couplers. Cross bracing installed coupler-to-coupler and base-to-coupler in a manner preventing unwanted rotation of various components of the pedestal assembly.

While embodiments of a ballast block deck system and pedestal assembly have been described in detail, various modifications, alterations, and changes may be made without departing from the spirit and scope of the ballast block deck system and pedestal assembly according to the present invention as defined in the appended claims.

What is claimed is:

1. A stabilizing system for a deck system comprising:

a plurality of pedestals, each of the pedestals supporting corner portions of adjacent blocks, pavers or panels a spaced distance above an underlying structure extending generally parallel to the blocks, pavers or panels, and each pedestal having:

a support having a plate with defined separate quadrants to support the corner portions and a substantially cylindrical post extending from a lower surface of the plate;

a base positioned at a lower end thereof and having a base plate and a base post extending from the base plate;

a coupler that adjustably interconnects the support and the base, the coupler having a connection portion to engage with the base post, a flange extending substantially orthogonal from the connection portion, and a plurality of projections extending from a surface of the flange; and a stabilizing member secured to and extending between at least two of the plurality of pedestals, the stabilizing member having end faces and a projection receiving member disposed at each end face to frictionally fit with one of the plurality of projections.

2. The stabilizing system according to claim 1, wherein each base includes a plurality of reinforcement walls that extend radially from an exterior of the base post and extend integrally from both the base plate and the base post, and wherein each of the plurality of reinforcement walls has a bracing securement eyelet formed therein.

3. The stabilizing system according to claim 2, further comprising bracing for restraining movement of the plurality of pedestals, the bracing including an elongate wire, wire rope, cable or rod having one end secured to the bracing securement eyelet of one of the plurality of pedestals and another end secured to the bracing securement eyelet of an adjacent one of the plurality of pedestals.

4. The stabilizing system according to claim 1, wherein the stabilizing member is a bar for restraining movement of the plurality of pedestals.

5. The stabilizing system of claim 4, wherein the plurality of projections are equally spaced-apart circumferentially about the flange, whereby a uniform distribution of the plurality of projections about the flange ensures that a each will substantially be opposed to a one on an adjacent pedestal thereby permitting ready placement of the stabilizing member between the plurality of pedestals.

6. The stabilizing system of claim 1, further comprising a bump receiving recess located inside the projection receiving member and a bump disposed on an outside surface of at least one of the plurality of projections extending from the flange.

7. The stabilizing system of claim 1, wherein the stabilizing member further comprises two telescoping halves whereby a length of the stabilizing member is adjustable.

8. The stabilizing system of claim 7, wherein the stabilizing member further comprises a projection on one of the two telescoping halves.

9. The stabilizing system of claim 8, wherein the stabilizing member further comprises a slot on the other half for receiving the projection.

10. The stabilizing system of claim 1, wherein the connection portion includes a hollow post extending from the flange and having continuous or discontinuous spiral threads provided on an inner surface thereof.

11. The stabilizing system of claim 10, wherein the end faces are contoured to complement the hollow post projecting from the flange.

12. The stabilizing system of claim 1, wherein the connection portion includes a substantially cylindrical, hollow post projecting from flange and a substantially cylindrical connection post that depends therefrom.

13. The stabilizing system of claim 12, wherein one of the plurality of end faces are contoured to complement the hollow post projecting from the flange.

14. The stabilizing system of claim 1, further comprising at least one projection disposed on and extending outward from a top surface of the base plate.

15. The stabilizing system of claim 1, wherein the end faces are contoured to complement the connection portion.

16. A stabilizing system for a fixed surface, comprising:

a plurality of pedestals, each of the pedestals supporting corner portions of adjacent blocks, pavers or panels a spaced distance above an underlying structure extending generally parallel to the blocks, pavers or panels, and each pedestal having:

a support having a plate to receive the corner portions and a substantially cylindrical post extending from a lower surface of the plate;

a base adapted to be positioned on the fixed surface and having a base post and a base plate extending outward from the base post;

a coupler connecting to the base post and having a flange positioned above the base post and extending circumferentially about a midsection of the coupler, and a plurality of spaced-apart projections extending orthogonally to a major surface of the flange; and a stabilizing member secured to and extending between at least two of the plurality of pedestals, the stabilizing member having a pair of end portions positioned near opposing ends of the stabilizing member and a pair of apertures extending through the pair of end portions to frictionally fit with one of the plurality of spaced-apart projections.

17. The stabilizing system according to claim 16, wherein each base includes a plurality of reinforcement walls that extend radially from an exterior of the base post and extend integrally from both the base plate and the base post, and wherein each of the plurality of reinforcement walls has a bracing securement eyelet formed therein.

18. The stabilizing system according to claim 17, further comprising bracing for restraining movement of the plurality of pedestals, the bracing including an elongate wire, wire rope, cable or rod having one end secured to the bracing securement eyelets of one of the plurality of pedestals and another end secured to the bracing securement eyelets of an in an adjacent one of the plurality of pedestals.

19. The stabilizing system according to claim 16, wherein the stabilizing member is a bar for restraining movement of the plurality of pedestals.

20. The stabilizing system of claim 19, wherein the plurality of spaced-apart projections are equally spaced-apart circumferentially about the flange, whereby a uniform distribution of closely-spaced projections about the flange ensures that a each will substantially be opposed to a one on an adjacent pedestal thereby permitting ready placement of the stabilizing member between the plurality of pedestals.

21. The stabilizing system of claim 20, further comprising a bump receiving recess located inside the pair of apertures and a bump disposed on an outside surface of at least one of the plurality of spaced-apart projections extending from the flange.

22. The stabilizing system of claim 16, wherein the coupler includes a hollow post extending from the flange and having continuous or discontinuous spiral threads provided on an inner surface thereof.

23. The stabilizing system of claim 22, wherein the pair of end portions are contoured to complement the hollow post extending from the flange.

24. The stabilizing system of claim 16, wherein the coupler includes a substantially cylindrical, hollow post projecting from the flange and a substantially cylindrical coupler post that depends therefrom.

25. The stabilizing system of claim 24, wherein the pair of end portions are contoured to complement the hollow post projecting from the flange.

* * * * *

UNITED STATES PATENT AND TRADEMARK OFFICE

CERTIFICATE OF CORRECTION

PATENT NO. : 8,381,461 B2
APPLICATION NO. : 12/417942
DATED : February 26, 2013
INVENTOR(S) : John Repasky It is certified that error appears in the above-identified patent and that said Letters Patent is hereby corrected as shown below:

In the Claims

In column 6, line 47, claim 5, the "a" should be removed after "that" and before "each".

In column 6, line 48, claim 5, the "a" should be removed after "to" and before "one".

In column 8, line 19, claim 20, the "a" should be removed after "that" and before "each".

In column 8, line 19, claim 20, the "a" should be removed after "to" and before "one".

Signed and Sealed this
Seventeenth Day of September, 2013

Teresa Stanek Rea
*Deputy Director of the United States Patent and TrademarkOffice*